US005902195A

United States Patent [19]

Pavonetti

[11] Patent Number: 5,902,195

[45] **Date of Patent: *May 11, 1999**

[54] COLLAPSIBLE/PORTABLE SOCCER GOAL

[76] Inventor: Onofrio F. Pavonetti, 78 Dunwoodie St., Scarsdale, N.Y. 10583

[ * ] Notice: This patent is subject to a terminal disclaimer.

[21] Appl. No.: 08/770,551

[22] Filed: Dec. 23, 1996

Related U.S. Application Data

[63] Continuation-in-part of application No. 08/354,477, Dec. 12, 1994, Pat. No. 5,586,768.

[51] Int. Cl.[6] ..... A63R 63/00

[52] U.S. Cl. ..... 473/478; 273/400

[58] Field of Search ..... 273/400, 901, 273/402, 398, 704; 473/476, 478

[56] References Cited

U.S. PATENT DOCUMENTS

| | | | |
|---|---|---|---|
| D. 213,573 | 3/1969 | Adolph . | |
| D. 337,363 | 7/1993 | Pavonetti . | |
| 4,083,561 | 4/1978 | Daffer, Jr. . | |
| 4,127,272 | 11/1978 | Pennell . | |
| 4,368,891 | 1/1983 | Neisius | 273/400 |
| 4,407,507 | 10/1983 | Caruso et al. . | |
| 4,420,158 | 12/1983 | Klock et al. . | |
| 5,186,469 | 2/1993 | Terris . | |
| 5,316,314 | 5/1994 | Wilson . | |
| 5,372,368 | 12/1994 | Pavonetti | 273/411 |
| 5,413,356 | 5/1995 | Bigelow . | |
| 5,586,768 | 12/1996 | Pavonetti | 273/400 |

FOREIGN PATENT DOCUMENTS

| | | |
|---|---|---|
| 2485379 | 6/1980 | France . |
| 2636659 | 9/1988 | France . |
| 2122323 | 11/1972 | Germany . |
| 2448366 | 10/1974 | Germany . |
| 2847701 | 5/1980 | Germany . |
| 284604 | 11/1988 | Germany . |

*Primary Examiner*—Mark S. Graham
*Attorney, Agent, or Firm*—Lackenbach Siegel Marzullo Aronson & Greenspan

[57] ABSTRACT

A collapsible soccer goal for an athletic field having a matched pair of vertical side supporting frame sections, and a crossbar beam having a plurality of horizontal sections. All of the vertical and some of the horizontal sections comprising a locking hinge enabling some of the sections to be folded in half. The plurality of horizontal sections are detachably connected together by either locking and/or clamping means to form the overall 24 foot standard crossbar beam; and the vertical frame sections each having an overhead hinge removably connectable to a horizontal section for clamping and pulling together all sections of the horizontal crossbar beam to the two vertical goal posts.

25 Claims, 14 Drawing Sheets

(CENTER CROSSBAR LOCKED JOINT – WITH LATCHES NOT SHOWN AND FLANGES SHOWN AS PLATES FOR EASE OF UNDERSTANDING)

18
18
56
56
92
180
94
180
92
94
66'
51
59'
69
90
68
80
76
72
74
78
68
70
76
72
74
78
80
54
400
400
68
70
118
120
118'

STORED POSITION OF
VERTICAL POSTS WITH
SIDE AND REAR PANELS

STORED POSITION OF CROSSBAR BEAMS

COLLAPSIBLE/PORTABLE SOCCER GOAL

RELATED PATENT APPLICATIONS

This application is a continuation-in-part of my U.S. patent application, Ser. No. 08/354,477, filed Dec. 12, 1994, now U.S. Pat. No. 5,586,768, issued Dec. 24, 1996.

FIELD OF THE INVENTION

The invention relates to a light weight and compact, self standing soccer goal when erected, and in particular to a portable and/or collapsible one which may be folded into a plurality of small packages (or boxes) which are readily transportable, and can be conveniently carried by a person and placed in a trunk of a car or a vehicle, whereby the goal can be placed readily by one person on any open field anywhere.

BACKGROUND OF THE INVENTION

Ball playing fields, such as for soccer and other sports are large in size and require considerable space. Many facilities, such as schools have limited funds or space, and consequently the same playing field is used for many different types of sports. Unfortunately, with such arrangements, considerable time is required to set up the field for each type of sport played. In the case of soccer, large, full size and uncollapsible goal posts are mounted on wheels for rolling same into position at opposite ends of the field, and these goal posts can only be transported from field to field on a flat bed truck. These movable goals are heavy and bulky, requiring considerable manpower or power equipment to move them from a remote level storage area nearby to the goal lines. Also, as these movable goals are not collapsible, they must be stored out in the open, and thus are subjected to the elements as well as vandalism. Frequently, the equipment is in need of repair due to such conditions such rigid goal posts require considerable time for set up and removal when a field is changed from one sport to another. These full size goal posts are about 9 feet high as one foot of each vertical post is inserted into coverable holes at the goal lines. Such embedded goal post ends keep the goals securely in position at all times.

Other soccer goal posts comprise nothing more than a series of telescoping poles connected to form the standard rectangular goal area set by the professional leagues (8 feet by 24 feet size opening), with a pair of rearward extending supporting poles running from the top two corners of the vertical goal poles to the ground. A net is then supported from all poles and fastened to the ground for catching all balls driven into the net. One of the disadvantages of this type of goal construction is that it can be very dangerous as a death has been reported where an athlete was impaled by one of the poles when the goal was broken up in a collision on the field. A further soccer goal specification requires that the poles and crossbar be 4 inches, as required by the National Collegiate Athletic Association.

Further goals are shown in the following literature:

| U.S. PATENT DOCUMENTS | | |
|---|---|---|
| 5,048,844 | 9/91 | Haseltine |
| 2,220,158 | 9/35 | Oakes, et al. |
| 4,702,478 | 10/87 | Kruse |
| 4,420,158 | 12/83 | Klock |
| 2,449,708 | 9/48 | Lindsay |

-continued

| | | |
|---|---|---|
| 4,083,561 | 4/78 | Daffer, Jr. |
| 4,127,272 | 11/78 | Pennell |
| 4,407,507 | 10/83 | Caruso |
| D 213,573 | 3/69 | Adolph |
| D 337,363 | 7/93 | Pavonetti |
| FOREIGN PATENT DOCUMENTS | | |
| 2,632,868 | 12/89 | France |
| 2,630,921 | 7/78 | Germany |
| 2,335,693 | 1/75 | Germany |
| 2,448,366 | 4/76 | Germany |

The above references have many deficiencies, including the use of support/anchoring guy wires which players invariably trip over and are injured in a fall on the field.

Many injuries and fatalities have occurred on athletic fields using existing soccer goal posts, and these accidents are due to a number of reasons, including improper installations, or the use of unanchored or poorly anchored goal posts. Many fatalities are reported by the New York State Department of Health (18) were due to falling soccer goal posts from 1979–1993. Thus, there is a need for improved goal posts for soccer which are normally not inclined to fall over due to its novel construction. In addition, some of the injuries and fatalities occurred when unused soccer goals toppled over due to persons climbing aboard same. A collapsible/portable soccer goal clearly avoids such problems of fixed wheeled soccer goals, etc.

OBJECTS AND SUMMARY OF THE INVENTION

It is an object of the invention to provide a totally collapsible soccer goal which can be folded down into four basic relatively small elongated rectangular boxes which are lightweight and portable, and a few additional members, all of which can be wrapped into a small compact bag and carried by a man and transported in the trunk of a car. The trunk should be of a size for a five foot long object as the rear strut of the invention is the longest part or member. All other parts or members are shorter in length.

It is a further object of the invention to provide for a much more improved, and collapsible or portable soccer goal which is lightweight in construction, but yet strong and stable when erected and set up for use.

A further object of the invention is to provide a more improved and simplified soccer goal which is more readily assembled, and one which meets all industry standards be they NCAA or professional; and to provide complete flexibility in that such novel soccer goal can be fabricated from various materials, such as wood, plastic or metal, such as lightweight metals and alloys, including aluminum, magnesium and alloys thereof.

DESCRIPTION OF THE PREFERRED EMBODIMENT(S)

Figure 1:
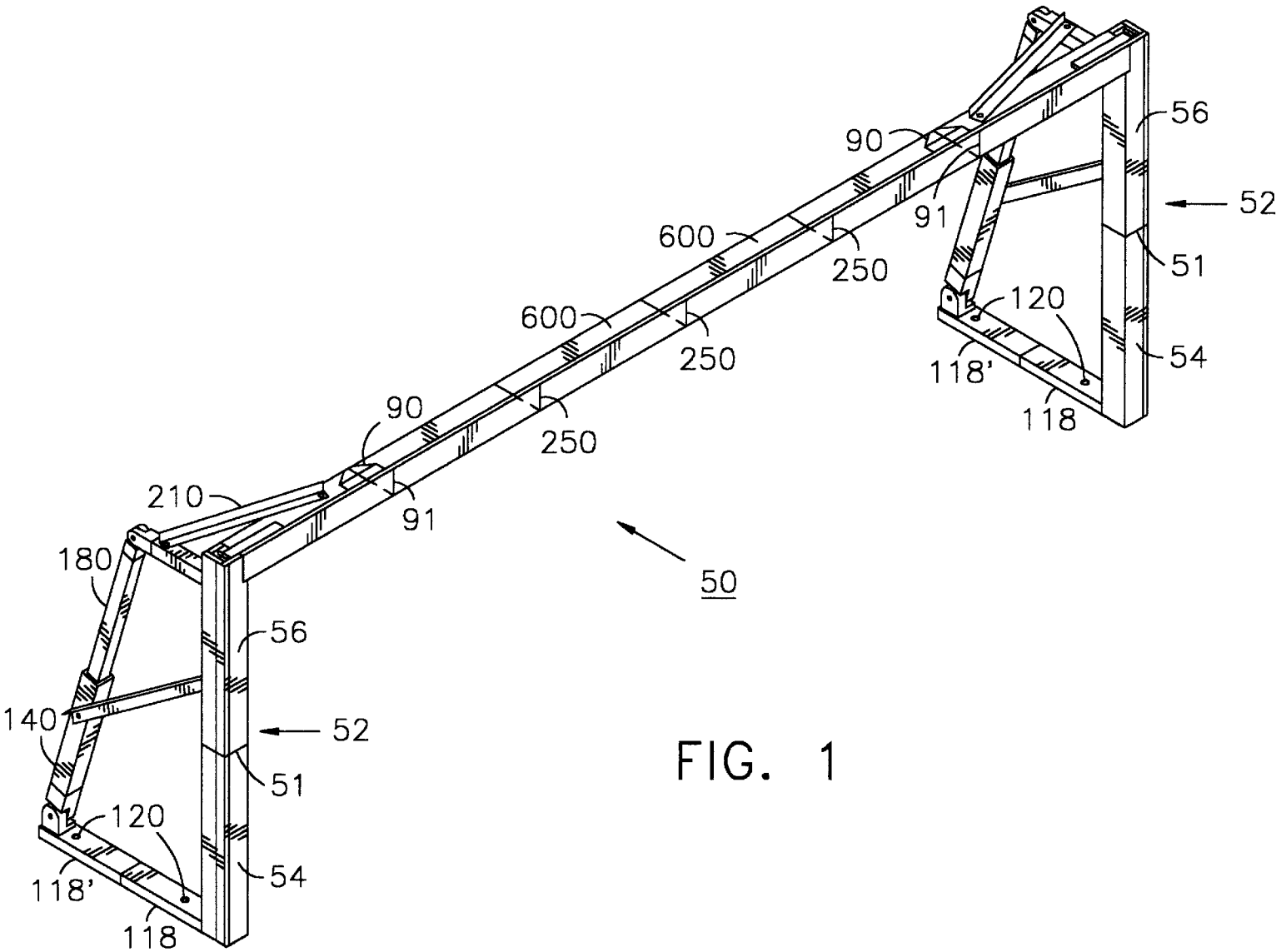
FIG. 1 is a front perspective view of my further improved collapsible or portable soccer goal in the set-up condition.
Figure 2:
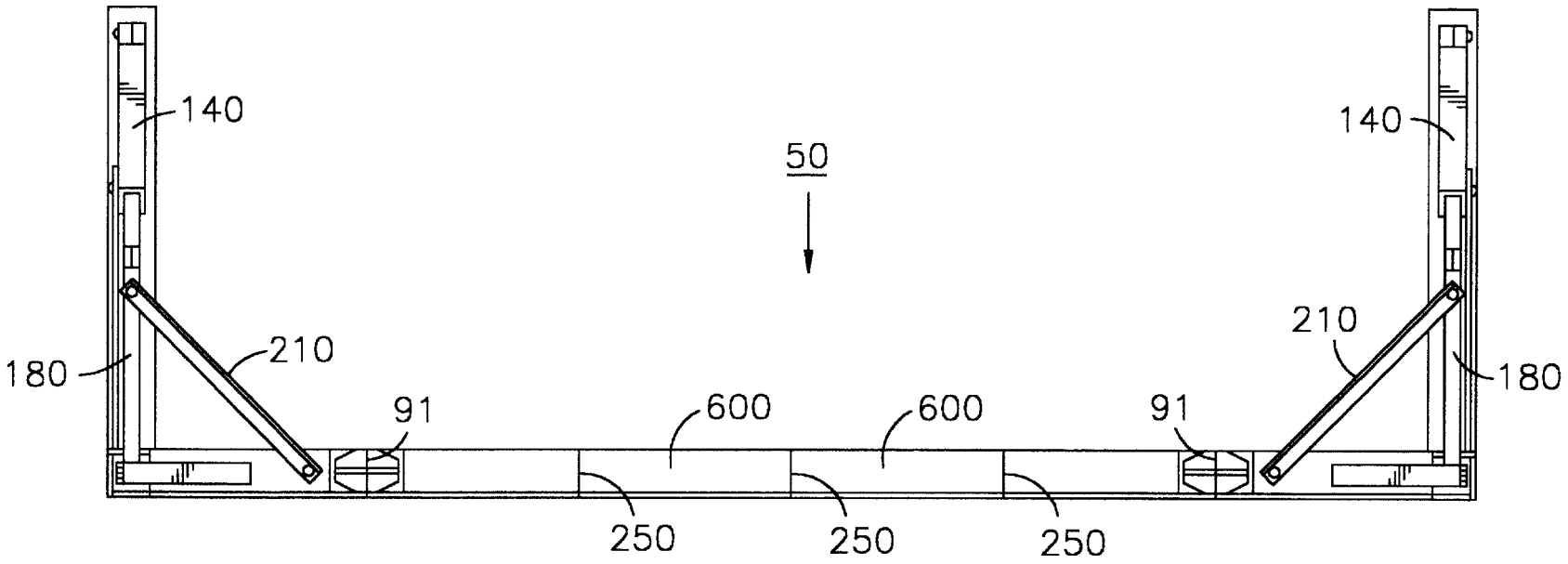
FIG. 2 is a top plan view thereof.
Figure 3:
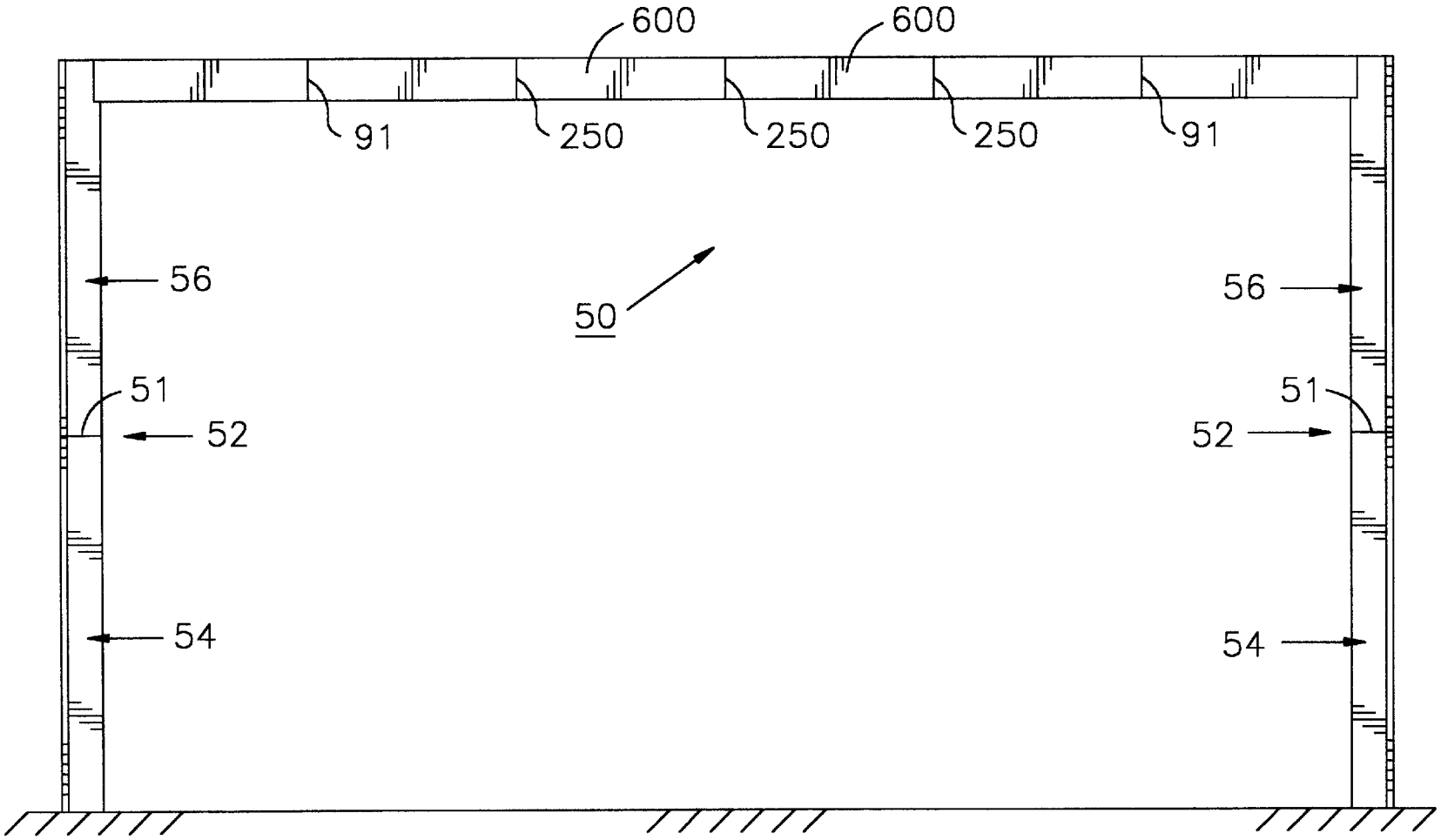
FIG. 3 is a front view thereof.

Referring now to the drawings wherein like numerals are employed for like elements, and more particularly to FIGS. 1–22, there is shown my novel soccer goal 50 of the present invention. As shown therein and more particularly in FIGS. 1–10, the soccer goal comprises a pair of opposed side supporting structures 52 which support a top horizontal beam that is a 24 foot (regulation) length four inch crossbar beam of right angle configuration. My copending application to issue as U.S. Pat. No. 5,586,768 on Dec. 24, 1996 employs four, equally sized, top crossbar sections, whereas in this application, I use now six equal sections of 4 feet each totalling 24 feet. With this construction, greater flexibility is provided for both regulation goal posts and reduced, practice size goal post which are 16 or 20 feet apart. Thus, with this new alternate construction, I employ in the middle crossbar sections the same locked connections so as to permit various sized openings of the goal post of my invention, as may be required, that is, either 24 ft, or 16 ft or 20 ft.

With this type of structure, a coach, school, university, etc. need only install a single goal post which can be adjusted to the desired regulation 24 foot width, or to a goal opening of either 16 or 20 feet. The soccer goal shown therein is collapsible in that the goal can be readily broken down into just four, 4 inch×4 inch, box-like structures as will be explained hereinafter. Each side supporting structure 52 forms a separate box (with the top crossbar beam forming two similar boxes, with two extra "loose" elements.) Thus, the folded side supporting structures and top beam with their back-to-back angled side flanges folded (hinged closed), form generally four 4×4 inch boxes with the adjacently disposed "loose" elements for carrying same (see FIG. 22) as a unit in a bag, or for shipment and/or storage.

In the case of the two side supporting structures, (4"×4" boxes), same are about 4 feet long (4 ft. 2 inches); and each crossbar beam section is about 4 feet long, except the two end beams are slightly longer in order to rest on the inside flanges of the vertical side walls of the goal posts which face each other. Thus, considerable savings in storage space is achieved with such a construction, and damage by vandals is eliminated entirely as such portable soccer goals can be locked away in a closet. Thus, a pair of goal posts for a soccer field can virtually be set up in minutes by the coaches and players with ones hand on site without tools as compared to the present conditions where permanent goal posts are fixedly mounted in cement or sleeves fixed in concrete, or where manpower and/or machines are required to move heavy rigid, movable, soccer goals into position.

Figure 4:
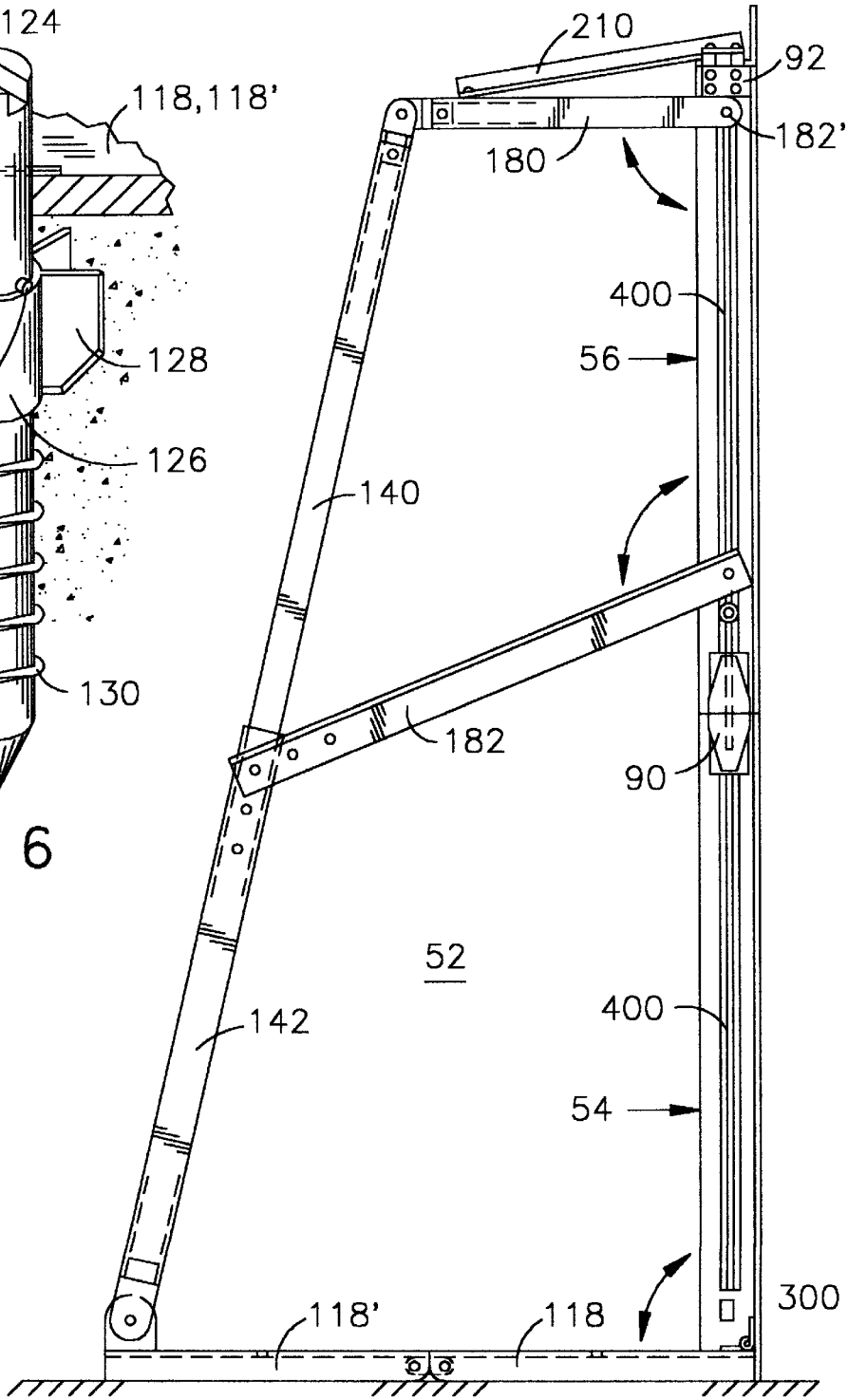
FIG. 4 is a typical side elevational view illustrating the side supporting elements or struts.

As best shown in FIGS. 4 and 5, each side supporting structure comprises lower and upper angled 4 inch frame members, 54 and 56, respectfully. Each side of the angled frame members is a 4 inch face (regulation width), and one four inch face is directed to the field, with the other four inch face disposed on the inside of the vertical goal supports parallel to the other, and the bottom of the top horizontal 4 inch crossbar beam, facing the ground.

Figure 9B:
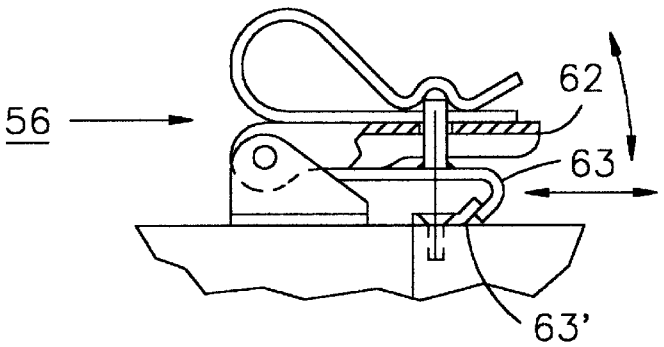
FIG. 9B is a detail side view, partially in section showing a latch and keeper with a spring pin for retaining the latch in a locked closed position.
Figure 14:
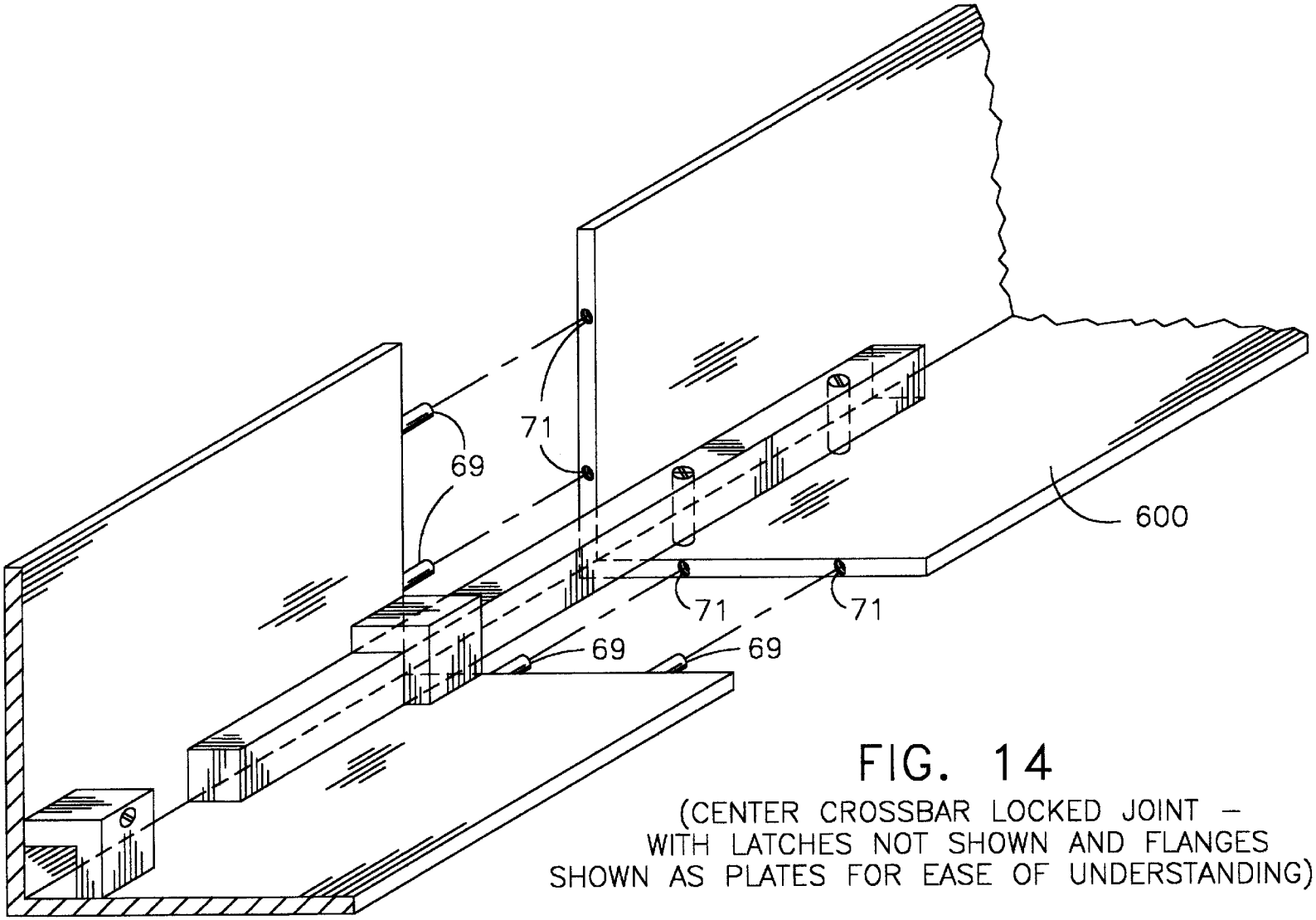
FIG. 14 is another fragmentary detail locking joint view, of one of the center three joints having no "locking hinge", in perspective showing mating pin/rod elements, shown suitably as a square bar, for the opposite beam parts of the 4 inch beam element for supporting the crossbar of the goal post; but with the adjacent pair of latches not shown herein as same as illustrated in FIG. 9A at such a typical locked joint.
Figure 20:
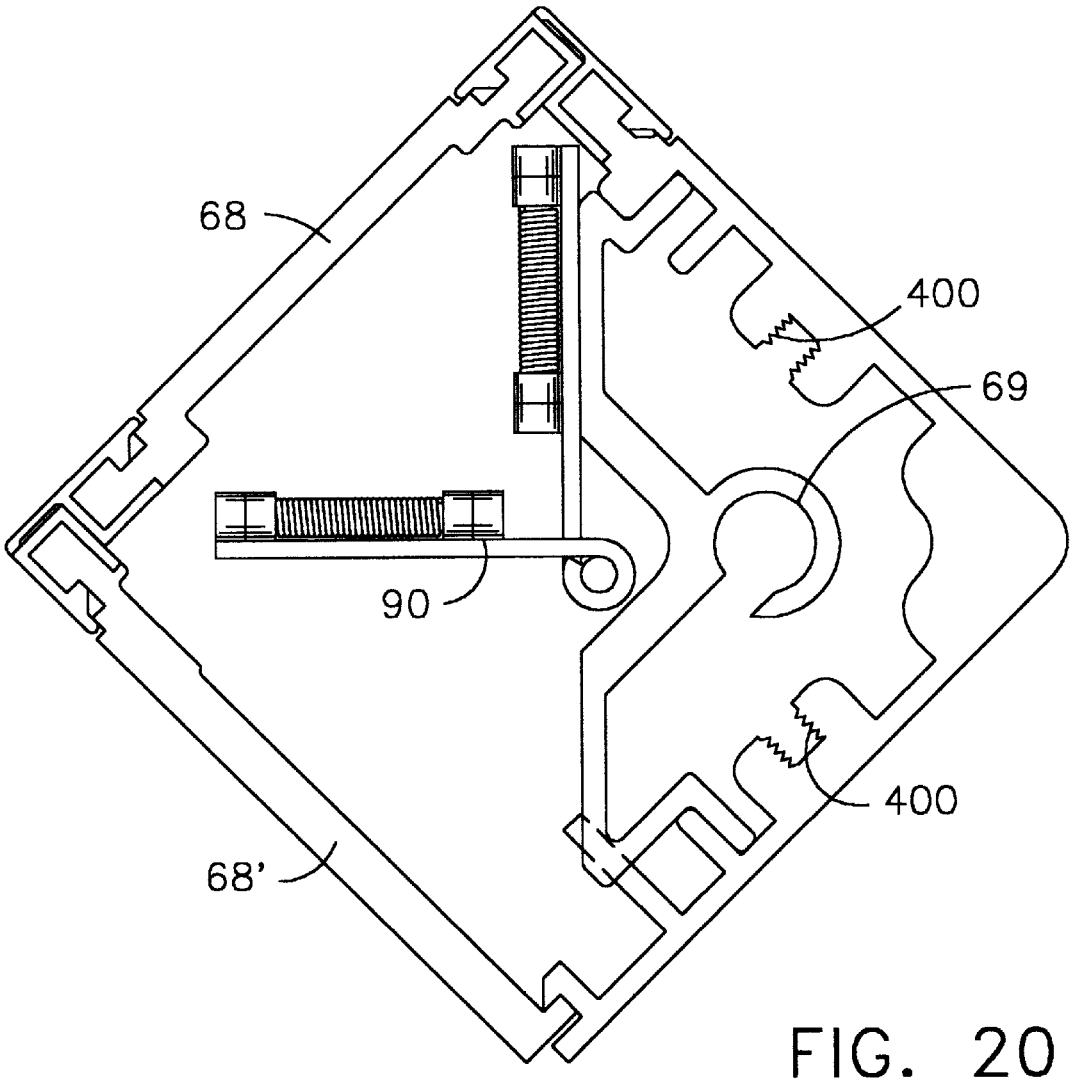
FIG. 20 is a view, similar to that of FIG. 19, but illustrating the hinge in the open and locked position; with side and rear panels hinged together along one edge and their other edges, respectively, hinged to the right angle goal post (extrusion) by means of a living hinge, and locked along the remaining corner edge diagonally opposite the living hinge edge.
Figure 21:
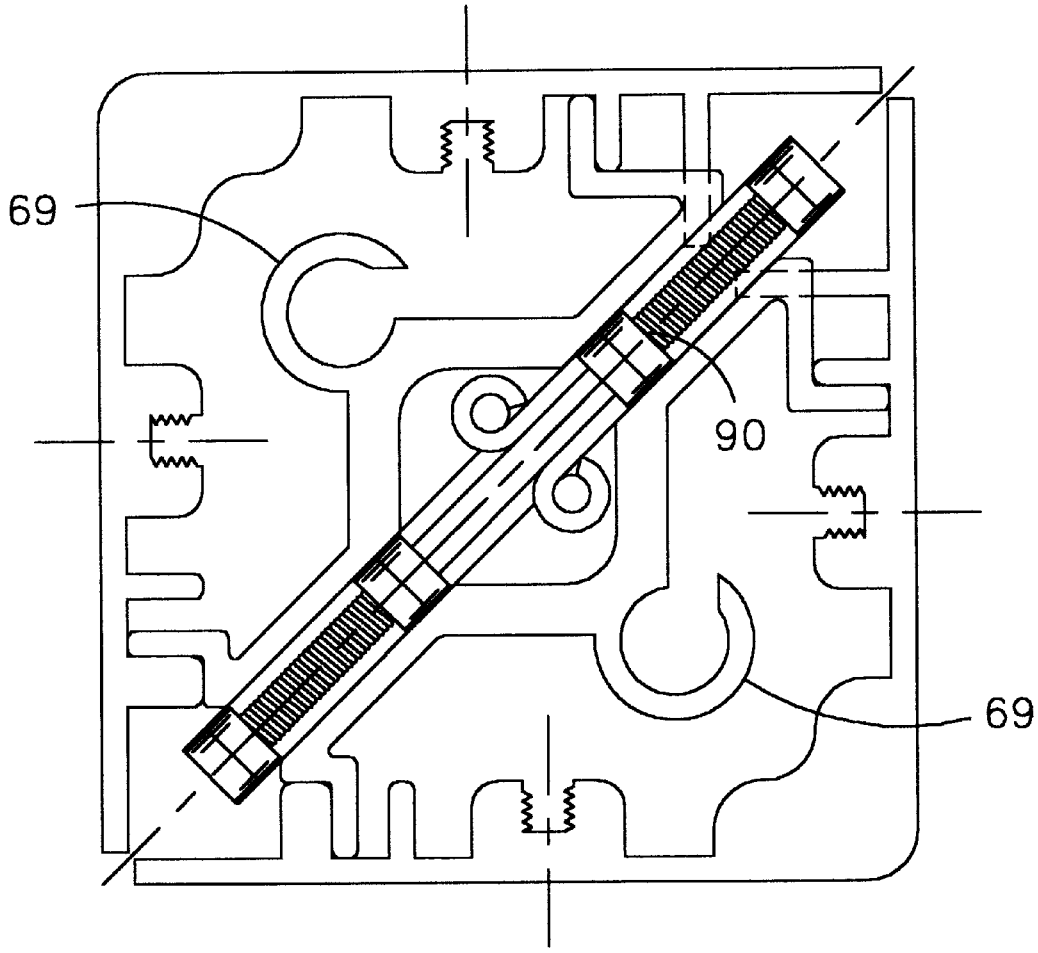
FIG. 21 is a detail view, in cross-section of a typical, top crossbar member (also shown in FIG. 13), but in the closed, stored position.
Figure 22:
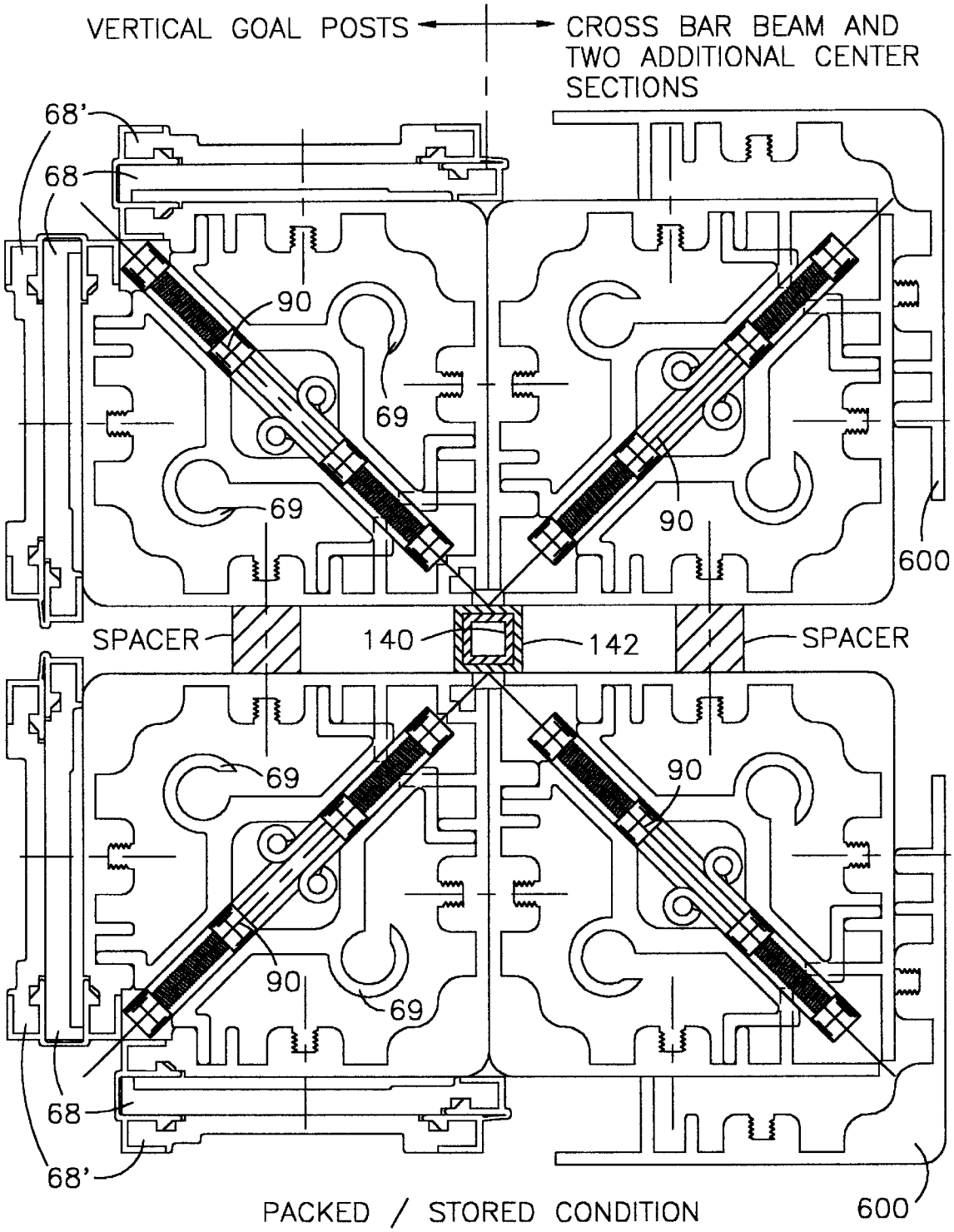
FIG. 22 is a cross-sectional view like FIGS. 19 and 21, but showing the four vertical goal posts in a stored, transportable position, with the additional, two center, crossbar members and the telescoping backstay strut and a pair of spacers suitably pinned to closed faces of the goal posts, and positioned in a compact, juxtaposed relationship with the four (4"×4") boxed vertical struts. This entire "packaged" can be tied with bungie "strings" and placed in a suitable carrying bag or "duffle" bag.

The top beam is made up of generally six 4 foot sections (regulation goal zone or area being 8 feet high by 24 feet long), with the two center section elements thereof locked together, in the middle; and their opposite ends also locked to their next adjacent section elements. The two outermost cross bar elements rest on the inside flange area of the two vertical goal posts. Also, as shown in FIG. 9, conventional latches 58 are mounted on the side flanges of the angled cross-beam, and have a hook or catch (not shown) and a hinged pull down handle 62 for pulling the hook 63 or catch causing the two part latch to hold tightly together the jointed elements. In FIG. 9B, the keeper 63' is shown latched by the latch hook. This type of latch is conventional and is available from the Reid Tool Supply Company, and is better known as a Southern latch. Also, with a "pinned" construction, as best shown in FIG. 14, the faces of the 4 inch sides align up precisely, so that from the field the goal posts and top beams project a smooth clean solid beam of 4 inches for facing the playing field. As shown therein, suitable pins or dowels 69' and apertures 71 are employed in both side flanges of the angled crossbar sections for aligning adjacent angled side faces to each other so that a clear smooth flat continuous outer side surface faces the playing field. The right angle element may be suitably an extrusion of metal, such as aluminum, and is more particularly show in FIG. 20 showing the locked hinged position with the hinged side and rear panels secured to the free edge of the right angle goal posts. Threads 400 run vertically (like endless gear teeth) for generally the full length of the right angled elements and are used for adjusting the struts at desired elevations or angles so as to render the side supports rigid when assembled and aid in achieving level posts as well.

Figure 9A:
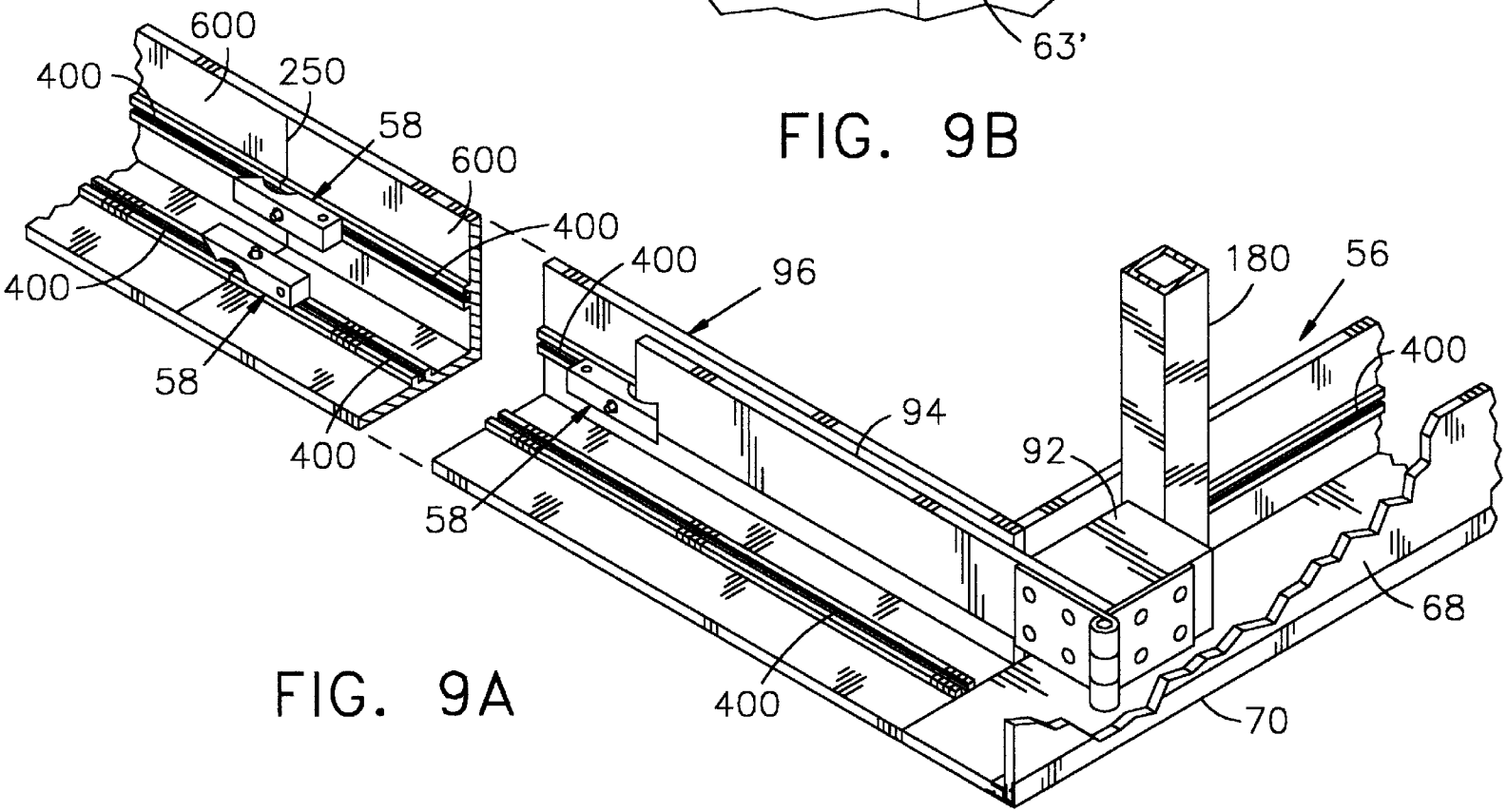
FIG. 9A is an enlarged fragmentary view illustrating one of the two corner crossbar members employed in maintaining the 24 foot horizontal top beam of the soccer goal together in a tight locked connection with the two vertical goal posts.
Figure 19:
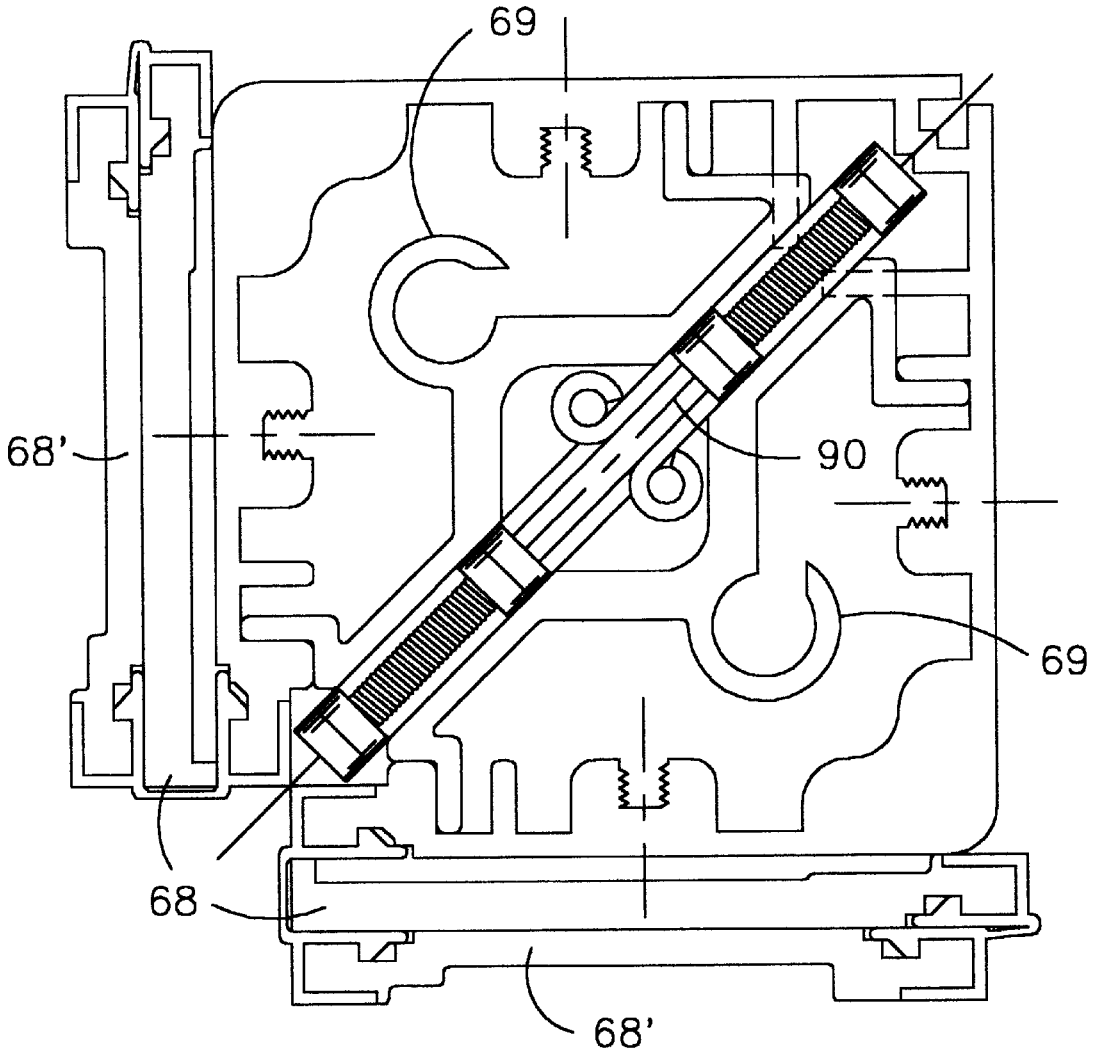
FIG. 19 is a typical, cross-sectional view of the vertical, front post, shown in the closed, folded hinged position, but with the other elements or struts omitted for ease of understanding.

In addition, my new portable soccer goal is provided with third and fourth side wall panels 68, and 68', as best shown in FIG. 9A (only one shown) and as shown in FIGS. 19 and 20. Both of such panels are suitably hinged at 70 for their full length so that no protruding end edge (side or rear) is exposed to a player. The hinge 70 enables the side wall panels 68 and 68' to be folded flat against the adjacent side panel (FIG. 19) or at a right angle thereto (FIG. 20) and all said elements are shown in enlarged detail in FIGS. 16–17. As shown therein, a conventional plastic living hinge 72 connects two grooves 74 and 76 having gripping means 78 and 80 in the form of a protrusion extending into a mating groove provided near the end edge of the 4 inch frame members.

It should be recognized that neither side wall panels 68 and 68' need be provided along the 24 foot length of the top beam as there is no need to protect the upper and rearward facing edges or areas of the 4" crossbar, horizontal beam. The front bottom edge being formed by the angled structure itself obviously needs no "protection" as it forms a complete corner with the adjacent side facing the ground. All such angled corners of all angled elements may suitably be rounded to a desired radius so as to present no sharp edges along any edges of the improved soccer goal of the invention, and also as may be required to conform to NCAA soccer regulations as noted hereinabove.

Figure 12:
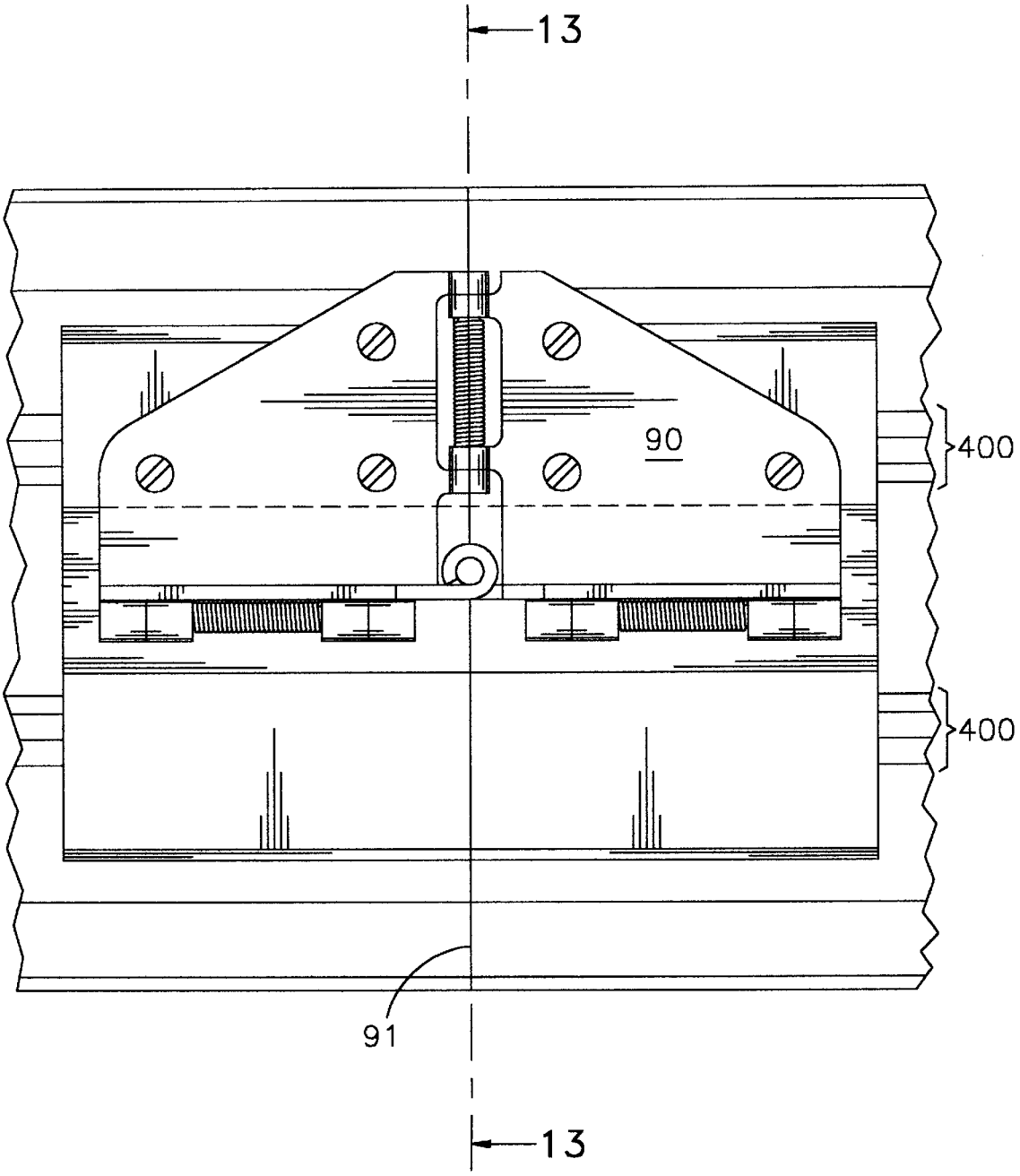
FIG. 12 and 13 illustrate, respectively a plan view; and a side elevational view in the hinge open position, showing one of the four conventional locking hinges employed by the soccer goal, but shown in the locked position when the hinged halves holding the opposite parts are folded so as to form a straight beam element (as shown in FIG. 12)
Figure 13:
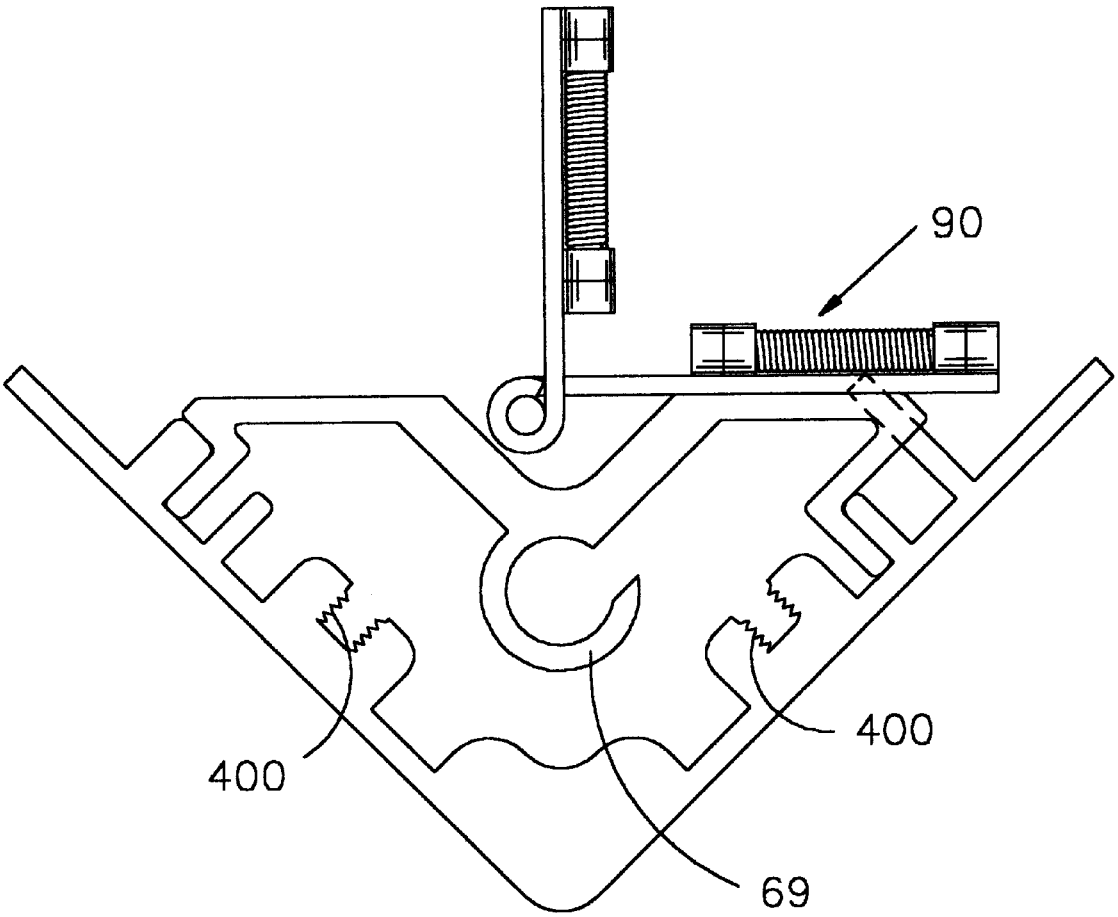

As shown in FIGS. 12 and 13, a conventional locking hinge 90 available in the marketplace is used at joints 51 of the vertical goal posts, and the outermost joints 91 of the crossbar beam. Thus, four locking hinges are required for enabling the vertical side supporting structures 54 and 56 to fold back upon each other; and for the two outermost crossbar sections of the top beam to be folded by virtue of the locking hinges employed at the one-sixth point marks along the top beam (see FIGS. 1–3 for best results in understanding this aspect or feature of the invention). Each locking hinge functions to lock itself and the juxtaposed structures it is holding together. While folded about itself, the locking hinge lays flat with its flanges facing each other (see FIGS. 19 & 21), but when in use, the hinge is angled at 90 degrees to prevent folding (see FIGS. 13 and 20). Folding the sections about each other occurs when the angled hinge is flattened out. The three remaining centermost joints 250 are locked, unhinged joints as will be explained hereinafter in greater detail.

Figures 15, 16, 17, 18:
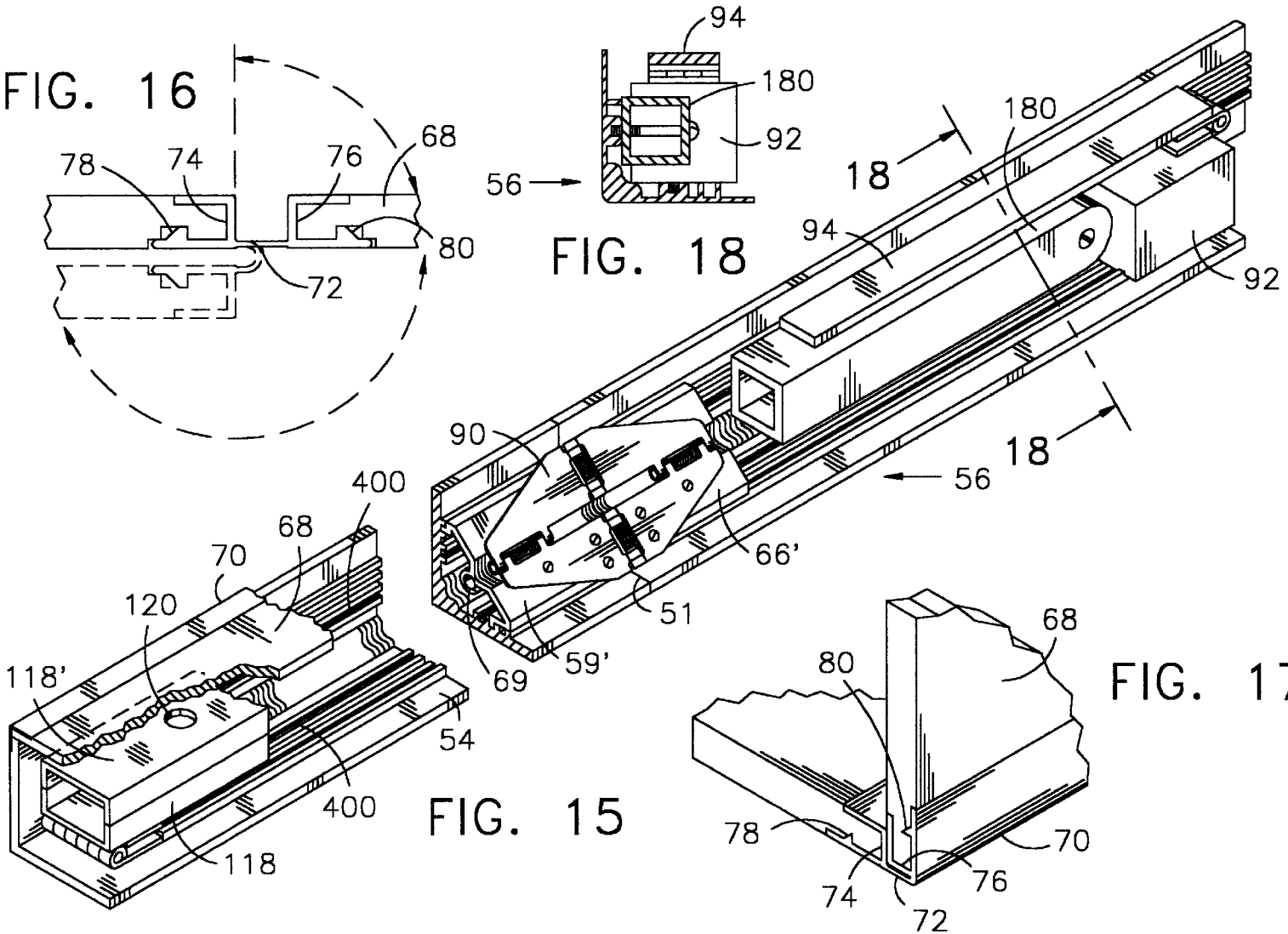
FIG. 15 shows one of the typical goal posts (unfolded), and with the other elements or struts of the goal post otherwise folded and "boxed" for portability.
FIGS. 16 and 17 are enlarged fragmentary views showing a conventional "living" plastic hinge with grooves having gripping means for securement to a panel or like element.
FIG. 18 is a cross-sectional view taken along lines 18—18 of FIG. 15.

As best shown in FIG. 9A, each upper angled side frame members 56 comprising two side faces, at least one of which supports a block 92 for a hinged crossbar locking member 94 mounted on a side of the block 92 by means of a plurality of screws or any other suitable fastener(s), which may be suitably employed to fasten the small half of the 270 degree swinging hinged channel-shaped crossbar member 94 to the block 92 (see also FIG. 15). This locking member 94 is important in the overall goal post structure as it holds the entire six crossbar beam sections tightly together, and to the two vertical goal posts so that the top beam is stiff, rigid and also generally parallel to the ground. It will be appreciated that the horizontal flange of the right angle crossbar will prevent bending or deflection of the crossbar if hit by a speeding soccer ball. The vertical facing flange of the crossbar keeps the horizontal bar straight and precludes it from sagging. The two cross bar members 94 (one on either side) are locked to the top beam by a suitable latch 58 with hook means 63 for grabbing a keeper 63' suitably provided at the end of locking member 94 for putting the locking member 94 under tension and tightly securing in place all of the horizontal beam sections to the pair of side frame members for forming a soccer goal which has generally, uniform and smooth flush 4"×4" faces in accordance with NCAA soccer regulations.

Figure 10:
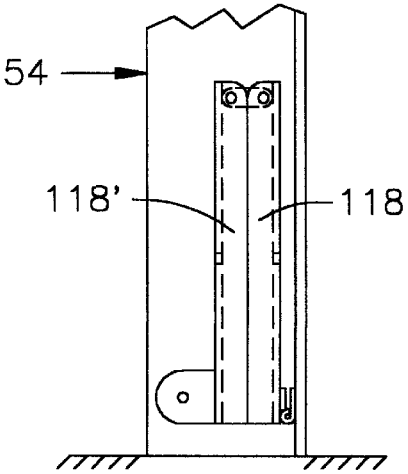
FIG. 10 is an enlarged, fragmentary detail view of front bottom corner of the goal post, and illustrating the lower or horizontal ground strut in the folded, stored position.
Figure 8:
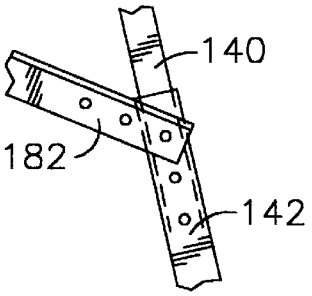

As best shown in FIGS. 4 and 10, each side supporting structure 52 includes a pivotable base having a pair of linked/hinged channel elements 118 and 118' which are provided with apertures 120 so that when folded outwardly and down along the ground, channel elements are secured to the ground by suitable mounts 122, such as driving and/or auger stakes which fixedly secure the goal post to the ground or turf. The mounts are driven through apertures 120 so that the side supporting structures 52 of the goal post are locked in place and immovable. Of course, weights, such as sandbags, can be placed on the channel elements so as to maintain the goal in place. Where stakes are utilized, two are preferred, one near the rear of each channel element and the other one near the front of each of the two vertical goal posts.

Figure 6:
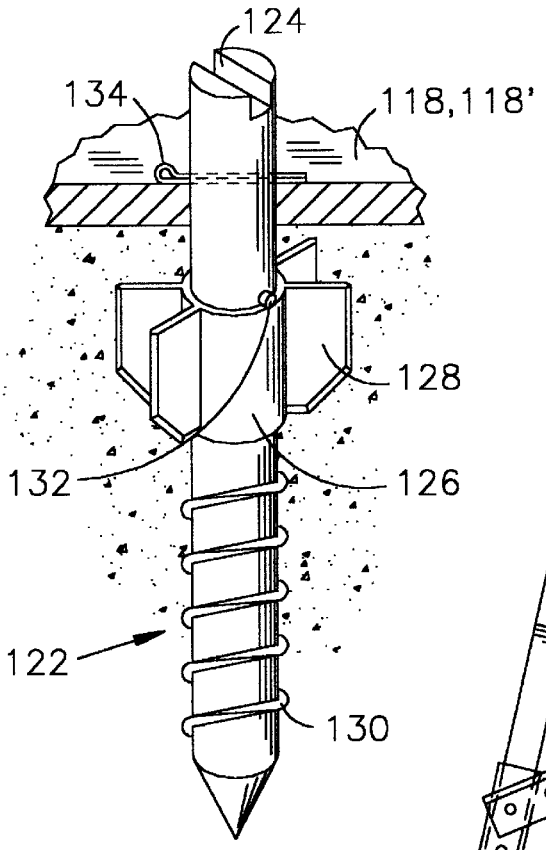
FIG. 6 illustrates a suitable anchor means for securing the two side horizontal ground struts or bases to the turf or ground where the goal is to be anchored.

An example of suitable anchoring means is shown in FIG. 6 as 122. Such a device is known as Threes available from the International Supply Co. of Upper Darby, Pa., 19082. Such devices are simply installed by rotating the stake by means of a large screwdriver or torque bar placed across the slot 124. The stakes 122 must all be placed into the ground first. A loosely fitted collar 126 with a plurality of fins 128 freely rotates between the auger threads 130 and the pin 132 about the stake 122, but gets wedged and anchored into the ground as the stake is further driven by rotation into the ground. A locking pin 134 or other suitable rod or cotter pin may be passed through an aperture in the upper end of the stake 122 for precluding the base 118, 118' from being lifted off the ground. Such pin 134 may be conveniently chained to the upper surface of one of the base 118, 118' so that the pins 134 are not lost each time the goal post is set up or broken down. In fact, any loose fasteners or other elements used with the collapsible goal post of the present invention may be suitably chained or otherwise "tied" to a large element of the basic apparatus so that none of the small parts are lost in shipment or while in storage. Each stake is designed to take loads up to 100 KN (about 22,500 lbs.). Such load conditions depend on stability of the surface area and type of ground conditions. Removal is just by counter rotation once the goal is lifted off the top of the stakes 122.

The overall structural parts of the collapsible/portable soccer goal are shown in both their erected condition and folded down or unerected condition. As shown, each side supporting frames 52 are substantially identical (matched-left and right units) or mirror images of each other, and their channel-shaped hinge element or crossbar member 94 pulls together tightly the sectional, overhead 24 foot long horizontal (standard 4 inch×4 inch goal) angle "iron" crossbar, as described hereinabove and as best shown in FIG. 9A which illustrates a typical locked joint (but without the pin shown in FIG. 14 for ease of understanding) and the latched channel element 94. Such a structure is clean and unencumbered, as compared to another type of soccer goal which is the combination of a soccer and a football goal. This goal post employs a "sideways ladder" truss structure atop the horizontal 24 foot crossbar for supporting a pair of upright extending high football goal posts. Many erroneous goals have been called where a soccer ball is deflected by a vertically disposed ladder rung member into the field and maintained in play especially when it ricochets faster than one can see and bounces in front of the goal. In reality, the ball was clearly "out of play" as it would have sailed out of bounds were it not for the truss above the horizontal goal crossbar beam. Thus, the goal of the present invention completely eliminates the possibility of any such incorrect judgment calls as there is no extra frame members or structure facing the playing field other than the standard 4 inch horizontal crossbar beam and the two vertical posts.

Figure 11:
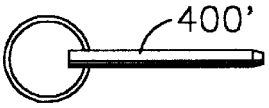
FIG. 11 is a view of one of the quick release pins for reinforcing the locking hinges.
Figure 7:
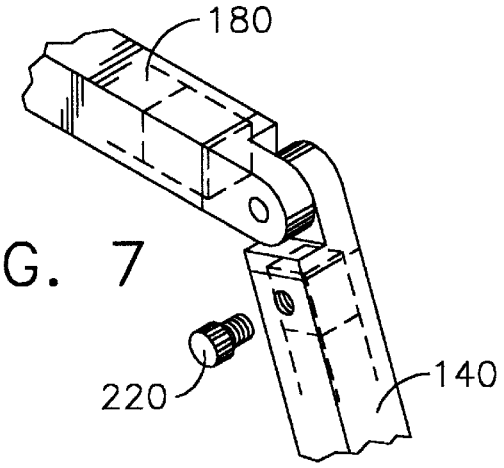
FIG. 7 and 8 show an enlarged, fragmentary detail views of the rear upper corner and middle strut connection, respectively; and the means for connecting the upper and intermediate/middle struts to the rear backstay framing which supports the goal and soccer net.

Each side supporting frame 52 comprises two sections 54, 56 (about 4 feet, 2 inches long each, the 2 inches being an adjustment for the 4 inch horizontal crossbar beam), and such sections are foldable about a locking hinge 90 mounted across joint 51, and the hinge 90 is attached to suitable hinge mount extrusions represented by the diagonal walls 59' and 66'. Such hinge mount extrusions are suitably secured by any type of fastener, such as bolts, screws, pins, welds, etc., to the right angle extrusions of both the vertical goal posts and the horizontal crossbar beam sections. "Quick release" reinforcing pins 400' shown in FIG. 11, are removably secured in C-shaped sleeves 69 forming part of diagonal walls extending across the right angle vertical goal posts of the invention. These pins may be chained to the goal posts so as not to be inadvertently misplaced or lost in use. The pins are used with all of the hinges and their lengths are suitably as long as the hinge length. Such pins are of conventional construction and marketed by the Reid Tool Supply Company, along with an attaching cable for securing the pin against being lost or misplaced by the user. Split (equal lengths) third side wall panels 68 running the full length of the sections 54, 56 are used to protect players from the goal's outer vertical corner edging, while at the same time shield the locking hinges and the connecting areas of the elements or struts should players run and impact into the front portions of the vertical side supporting frames. With the improved goal post of the invention, a rear panel 68', as best shown in FIGS. 19 and 20, forms a complete 4 inch square closed box system which clearly complies with NCAA soccer regulations. Where the rearwardly extending struts (top, intermediate, etc.) exist, such closed box vertical goal post is provided with suitable cutouts (not shown) in the rear panel or wall so as to allow passage therethrough of such struts.

As shown in the said Figures, the supporting elements or struts are in effect a plurality of braces totalling four (top, bottom, intermediate and rear struts) which join together to form a high strength side frame, but yet such side backstay frame is very light weight in construction and portable enabling the soccer goal to be folded up and packaged into just four similar elongated "boxes" of dimensions no larger than about 4"×4" by less than 5 feet. It will be appreciated that the side supporting frames function to support the overall goal itself and the horizontal overhead 4" beam facing the playing field, while at the same time hold the soccer net (not shown) in place about the sides, rear and top which must have at least a 2 foot depth to the net, in order to conform to soccer league regulations.

As shown, each side frame comprises a front vertical post and a top element or strut 180 extending rearwardly and substantially parallel to the ground channel elements 118, 118' and an intermediate strut 182 hinged to right angle element 56 with a vertical track adjustment means (parallel thread means) for use in aiding overall leveling and ensuring that the two front vertical goal posts are perpendicular to the ground or playing field while at the same time stiffening the side frame support structure. In this regard, a level 300 is suitably mounted in right angle element 54 for such purposes. The intermediate strut 182 is further adjustably pinned to a lower rear "independent/loose" strut 142 which is provided with a telescoping upper end element 140.

The side framing structure further is illustrated in detail in FIGS. 4–10, and as shown therein, the side frame comprises similar right angle corner elements 54 and 56 and folded base 118 and 118'. The top element/strut 180 rotates or folds down about pin means or axis 182' so as to reside within the upper angled corner frame 56. Note that all side or elements which brace the vertical side goal post so as to withstand all impact forces as well as forces exerted on the goal itself by kicked soccer balls, etc.

Figure 5A:
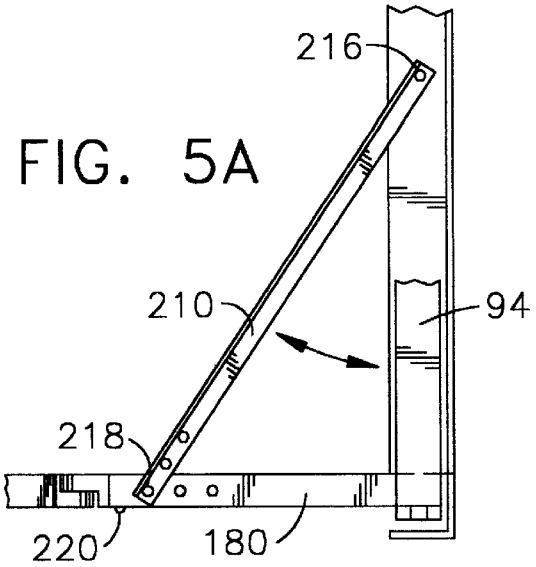
FIGS. 5A and 5B are enlarged, fragmentary detail views of the upper front corner of the goal post showing corner bracing; and the rear bottom corner (of the backstay), and illustrating means for securing in place the distal ends of the lower rear telescoping vertical brace member or strut and the lower or horizontal ground strut, respectively.
Figure 5B:
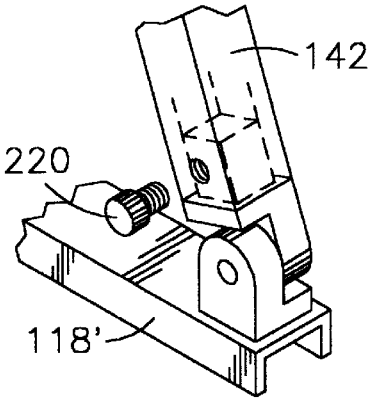

As best shown in FIG. 5A, and if desired, the soccer goal of the invention may also be provided with typical corner bracing elements/struts, each one extending inwardly at about a 45 degree angle from a side frame structure. Here the corner bracing element/strut 210 shown suitably comprises a right angle element. This element 210 is suitably pivotally mounted to the right angled top crossbar beam at 216; and the free distal end is suitably removably locked by fastener means 218 passing through element 210 and threaded into elements 180, which pin means is in the form of a common fastener element having a suitable thumb screw 220 for ease of assembly, such as that shown in FIGS. 5B and 7 for use at the upper and intermediate rear joints. It should also be apparent that pivot means 182' of strut 180 is the same in each of the two side frame structures of the invention.

Although the present invention has been described in some detail by way of illustration and example for purposes of clarity and understanding, it will, of course, be understood that various changes and modifications may be made with the form, details, and arrangements of the parts without departing from the scope of the invention as set forth in the following claims.

What is claimed is:

1. A collapsible soccer goal for an athletic field comprising: matched vertical side frame supports having a pair of vertical sections, and a crossbar beam having a plurality of horizontal sections including pairs of opposite end sections resting on at least a portion of said vertical side frame supports, all of said vertical and horizontal sections are formed of right angle elements; and a locking hinge enabling said pair of vertical sections and said pairs of horizontal end sections to be folded in half when disassembled; and some of said plurality of horizontal sections being detachably connected together by latching means and said pairs of said opposite end sections forming said crossbar beam; said vertical frame sections each having an overhead hinge removably connectable to a horizontal section for pulling tightly together said plurality of horizontal sections of said crossbar beam; said vertical frame sections comprising two right angle elements hingeably connected by means of said locking hinge, and a plurality of struts for supporting said right angle elements; and all of said plurality of struts except for a rear telescoping strut being erectable into a frame position from a stored position in both of said halves of said vertical sections; and said plurality of struts including at least a top strut generally parallel to said athletic field and connectably extending from one of said vertical sections; and an intermediate strut connected to said rear telescoping strut and one of said vertical sections of said pair of vertical sections forming said vertical side frame support.

2. The collapsible soccer goal according to claim 1, wherein at least one of said struts is storable in one of said halves of said pair of vertical sections.

3. The collapsible soccer goal according to claim 2, wherein said plurality of struts includes at least a top strut parallel to said athletic field and connectably extending from an upper half of said vertical section; and said rear telescoping strut connected to said top strut and generally facing opposite to said right angle elements.

4. The collapsible soccer goal according to claim 3, wherein said rear telescoping strut is removably connected to all said struts extending from said pair of vertical sections.

5. The collapsible soccer goal according to claim 4, wherein said rear telescoping strut extends from said top strut to a strut secured to said athletic field.

6. The collapsible soccer goal according to claim 5, wherein said intermediate strut is adjustably disposed along the length of said one half of said vertical sections.

7. The telescoping soccer goal according to claim 6, further including said ground strut being pivotally connected to the other half of said vertical section and to said rear telescoping strut.

8. The collapsible soccer goal according to claim 7, wherein said ground strut comprises two struts connected at a center joint area, with said two struts stored in a folded up position against a flange of said other half of said vertical section.

9. The collapsible soccer goal according to claim 8, including means for anchoring said ground strut to the athletic field.

10. The collapsible soccer goal according to claim 8, wherein said rear telescoping strut is further provided with adjustment means for locking said intermediate strut in a position for securely bracing and in rigidly supporting said vertical side frame support.

11. The collapsible soccer goal according to claim 3, wherein said top strut and said rear telescoping strut are tubular in form, and said intermediate strut is angular in form.

12. The collapsible soccer goal, according to claim 1, wherein said crossbar beam and said pair of side supporting frame sections form a goal zone, and said overhead hinges lock said pair of vertical side supporting frame sections to said crossbar beam by latches connectable to said overhead hinges, whereby said plurality of horizontal sections are tightly pulled together between said vertical side supporting frame sections.

13. The collapsible soccer goal according to claim 1, wherein each said vertical frame section when folded in half about said locking hinge forms a box by means of said two right angle elements mating together, with all of said plurality of struts except for said rear telescoping strut fitting within said box, so as to form a compact portable package.

14. A collapsible soccer goal for an athletic field, comprising: matched vertical side frame supports having a pair of vertical sections, and a crossbar beam having a plurality of horizontal sections including pairs of opposite end sections resting on at least a portion of said vertical side frame supports, all of said vertical and horizontal sections are formed of right angle elements; and a locking hinge for enabling each said pair of vertical sections and said pairs of horizontal end sections to be folded in half when disassembled; and some of said plurality of horizontal sections being detachably connected together by latching means and said pairs of said opposite end sections forming said crossbar beam; said vertical frame sections each having an overhead hinge removably connectable to a horizontal section for pulling tightly together said plurality of horizontal sections of said crossbar beam; said vertical frame sections comprising two right angle elements hingeably connected by means of said locked hinge, and a plurality of struts for supporting said right angle elements; and all of said plurality of struts except for a rear telescoping strut being erectable into a frame position from a stored position in both of said halves of said vertical sections; said plurality of struts including at least a top struts generally parallel to said athletic field and connectably extending from one of said vertical sections; and an intermediate strut connected to said rear telescoping strut and one of said vertical sections of said pair of vertical sections forming said vertical side frame support; and each said vertical frame section when folded in half about said locking hinge forms a box by means of said two right angle elements mating together, with all of said plurality of struts except for said rear strut fitting within said box, so as to form a compact portable package; and at least one hingeable side panel wall being connected to one of said two right angle elements of each of said pair of vertical side supporting frame sections so as to form a U-shape, wherein said locking hinges are shielded for safety purposes; and said collapsible soccer goal including another hingeable side panel wall connected to said at least one hingeable side panel wall for completely enclosing the vertical posts so as to generally form a four inch square post.

15. A collapsible soccer goal for an athletic field, comprising: matched vertical side frame supports having a pair of vertical sections, and a crossbar beam having a plurality of horizontal sections including pairs of opposite end sections resting on at least a portion of said vertical side frame supports, all of said vertical and horizontal sections are formed of right angle elements; and a locking hinge enabling said pair of vertical sections and said pairs of horizontal end sections to be folded in half when disassembled; and some of said plurality of horizontal sections being detachably connected together by latching means and said pairs of said opposite end sections forming said crossbar beam; said vertical frame sections each having an overhead hinge removably connectable to a horizontal section for pulling tightly together said plurality of horizontal sections of said crossbar beam; said vertical frame sections comprising two right angle elements hingeably connected by means of said locking hinge, and a plurality of struts for supporting said right angle elements; and all of said plurality of struts except for a rear telescoping strut being erectable into a frame position from a stored position in both of said halves of said vertical sections; said plurality of struts including at least a top strut generally parallel to said athletic field and connectably extending from one of said vertical sections; and an intermediate strut connected to said rear telescoping strut and one of said vertical sections of said pair of vertical sections forming said vertical side frame support; and said collapsible soccer goal including a net secured to each said angle element of all said right angle elements forming said pair of vertical side supporting frame sections and said horizontal sections, and wherein said net is secured by means of a plurality of net fasteners attached to the back panel pivotally secured to all of said vertical sections, and to a flange of said horizontal sections facing said athletic field.

16. A portable, take apart, knock-down soccer goal post for athletic field use, comprising: a frame of variable width having at least six main frame sections, a least four of which together form a right angled horizontal beam detachably supported on opposing flanges of a matched pair of two other main frame sections which include vertically disposed right angled eight foot section elements; and a plurality of rearwardly extending struts connected to said vertically disposed right angled section elements to form truss-like side supports of said horizontal beam; said truss-like side supports being said two other main frame sections; and said at least four horizontal beam sections being connected together as a unit, so as to form with said truss-like side supports a soccer goal perimeter; and a pair of latched hinges pivotally mounted to an uppermost portion of said two other main frame sections for holding together said horizontal beam to said truss-like side supports.

17. The portable, take apart, knock-down soccer goal post according to claim 16, including six right angled horizontal beam frame sections.

18. The portable, take apart, knock-down soccer goal post according to claim 17, wherein each of said two other main frame sections comprise hinge sets of upper and lower right angled section elements, each about four feet in length for forming each right angled eight foot section element; and said plurality of rearwardly extending struts being pivotally connected to said upper and lower section elements and to a rear strut facing generally parallel to said right angled eight foot section element to form each said truss-like side support.

19. The portable, take apart, knock-down soccer goal post according to claim 18, wherein said six right angled horizontal beam frame sections include hinges, and intermediate pinned joints therebetween.

20. The portable, take apart, knock-down soccer goal post according to claim 16, wherein said vertically disposed right angled section elements, include side and rear panels hingeably connected to each other, and to an edge of said right angled section element; and releasably secured oppositely thereto along another edge diagonally opposite to said edge of said right angled section elements.

21. The portable, take apart, knock-down soccer goal post according to claim 19, wherein said intermediate joints are centrally disposed on said horizontal beam, and each said intermediate joint has at least one elongated pin secured to one horizontal main frame element, and is removably secured to an adjacent horizontal main frame element.

22. The portable, take apart, knock-down soccer goal post according to claim 19, further including a corner bracing element between said horizontal beam and each of said truss-like side supports.

23. The portable, take apart, knock-down soccer goal post according to claim 19, wherein said plurality of rearwardly extending struts including top and bottom struts disposed generally parallel to the athletic field, and an intermediate strut.

24. The portable, take apart, knock-down soccer goal post according to claim 23, wherein said bottom strut comprises a pair of linked struts hinged to the lower right angled section elements.

25. The portable, take apart, knock-down soccer goal post according to claim 24, wherein in a knock-down, storable condition, all of said plurality of struts pivot into positions parallel to said right angled section elements, so as to enable said upper and lower right angled section elements to fold into a box-like structure upon said hinge being folded about itself.

* * * * *